United States Patent [19]

Sharp

[11] 4,184,308

[45] Jan. 22, 1980

[54] METHOD OF FORMING A PACKAGE FOR PRODUCTS AND THE RESULTING PACK

[76] Inventor: Anthony J. Sharp, Aylesham, England

[21] Appl. No.: 844,399

[22] Filed: Oct. 21, 1977

[30] Foreign Application Priority Data

Oct. 25, 1976 [GB] United Kingdom ..... 44230/76
Dec. 15, 1976 [GB] United Kingdom ..... 52310/76

[51] Int. Cl.[2] ..... B65B 61/14; B65B 43/10
[52] U.S. Cl. ..... 53/413; 53/453
[58] Field of Search ..... 53/30 R, 14, 37, 38, 53/184 R, 410, 413, 415, 453; 206/461, 464, 466, 467, 470

[56] References Cited

U.S. PATENT DOCUMENTS

| | | | |
|---|---|---|---|
| 2,757,793 | 8/1956 | Deitz | 53/30 X |
| 2,908,383 | 10/1959 | Vogt | 53/453 X |
| 3,014,638 | 12/1961 | Farley | 53/14 |
| 3,497,059 | 2/1970 | Watts | 53/453 X |
| 3,502,486 | 3/1970 | Lundquist | 206/467 X |
| 3,543,466 | 12/1970 | Forsberg | 53/415 |

FOREIGN PATENT DOCUMENTS

| | | | |
|---|---|---|---|
| 2411564 | 10/1974 | Fed. Rep. of Germany | 53/30 S |
| 1172697 | 2/1959 | France | 53/453 |
| 688167 | 3/1965 | Italy | 206/467 |
| 1313269 | 4/1973 | United Kingdom | 53/30 R |

*Primary Examiner*—Travis S. McGehee

[57] ABSTRACT

A method of forming a package for products wherein the basic pack is formed from one piece of plastics material suitably shaped to receive products, the products are placed in the shaped basic pack and then the plastics material is folded over to enclose the products and the ends of the plastics material are joined together.

2 Claims, 11 Drawing Figures

METHOD OF FORMING A PACKAGE FOR PRODUCTS AND THE RESULTING PACK

This invention relates to the packaging of products.

The invention provides a method of packaging one or more articles, comprising forming one or more transverse fold lines in a piece of sheet-form semi-rigid or rigid thermoplastics material so as to divide the piece of material into portions, forming one or more cavities for the one or more articles in at least one of the portions and leaving a flange at opposite ends of the piece of material, inserting the one or more articles in the one or more cavities in one of the portions, folding the piece of material about the one or more fold lines to bring the portions together, affixing a card to at least one of said flanges, the card extending outwards from the piece of material, and making a connection between said flanges.

The or each fold line may be formed to leave the portion of the material where the fold line is present completely flat or they may be formed by ridges, either male or female in the material. The fold lines may be formed by lines of perforations or by step slitting.

The piece of thermoplastic material may be cut or trimmed to a convenient size at any suitable stage during the packaging of the articles or after the package has been formed.

The invention further provides a package comprising a piece of sheet-form semi-rigid or rigid thermoplastics material divided by transverse fold lines into portions, one or more cavities being formed in at least one of the portions, a flange being present at opposite ends of the piece of material, the flanges being connected together, one or more articles located in the one or more cavities, and a card attached to at least one of the flanges and extending outwards from the piece of material.

The thermoplastics material may be transparent.

One or more of the cavities may be formed in each portion.

The two flanges and the card may be fixed together. Alternatively, the card may be fixed to one of the flanges and releasably engaged with the other of the flanges to make the connection.

The invention is described below by way of example with reference to the accompanying drawings.

Figure 1:
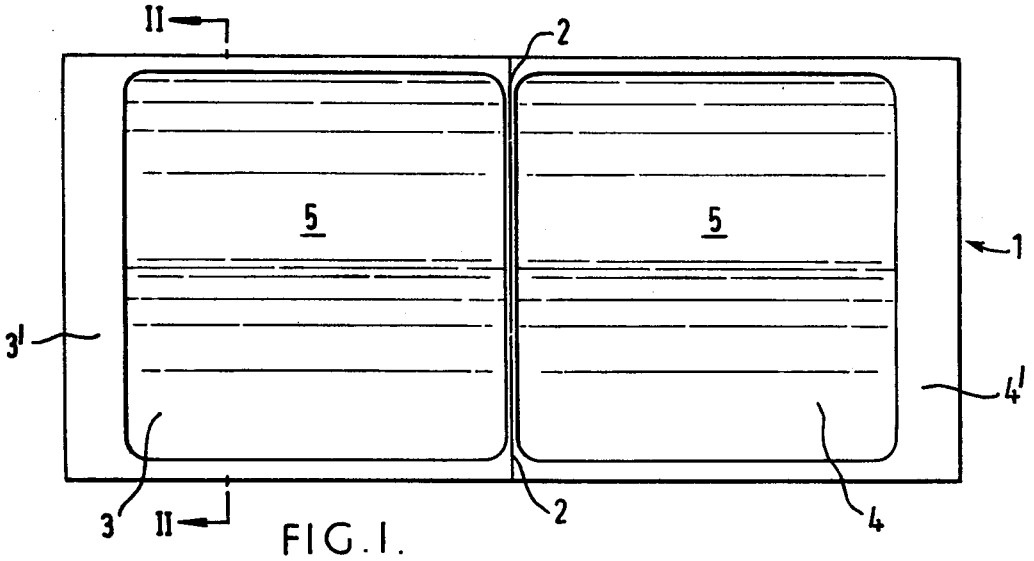
FIG. 1 illustrates a sheet of thermoplastics material molded into shape.
Figure 2:
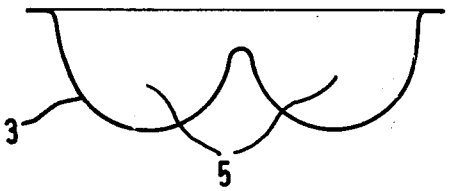
FIG. 2 is a section on the line II—II of FIG. 1.
Figure 3:
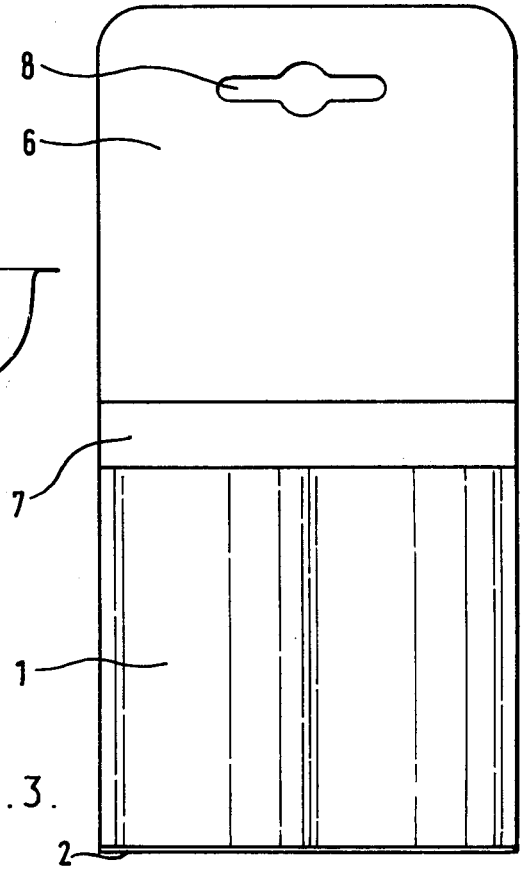
FIG. 3 represents a front view of a completed package comprising the thermoplastic sheet of FIG. 1.
Figure 4:
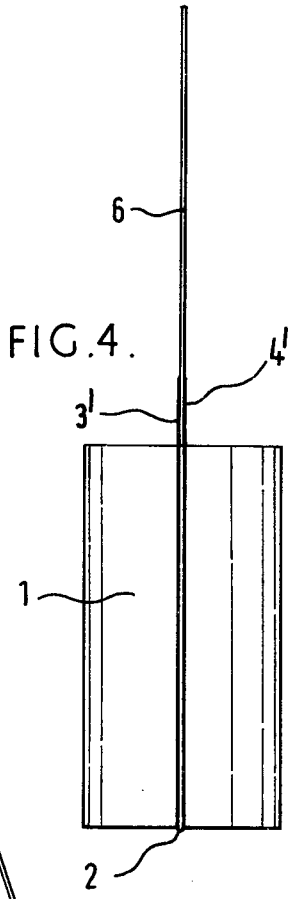
FIG. 4 is a side view of the completed package.

Referring to FIGS. 1 and 2, a piece 1 of semi-rigid or rigid thermoplastics material has fold lines 2 dividing the piece of material into two portions 3 and 4 each defining two cavities 5 and including flanges 3' and 4' at opposite ends of the piece. Each cavity 5 is, in transverse section, semi-circular in shape (or such other shape suitable to receive the product to be packaged).

The piece 1 is formed by moulding a single sheet of semi-rigid thermoplastics material to form the fold line 2 and the cavities 5 and to leave the cavities 5.

Two round type dry batteries (not shown) are placed (either during the moulding of the piece 1 or later) in the cavities of either the portion 3 or 4 and then the piece 1 is folded along the fold line 2 to bring the two flanges 3' and 4' together to thereby encase the batteries.

A card 6 is fixed, e.g. by adhesive, by staples or by heat-sealing to the two flanges 3' and 4' and thus a package is formed.

The card may have a hole 8 for the purpose of suspending the completed package. The base of the package is comparatively flat so that the package is capable of standing on its own base. Alternatively, the base of the package may be provided with shaped portions or segments on which the package can stand.

Figure 5:
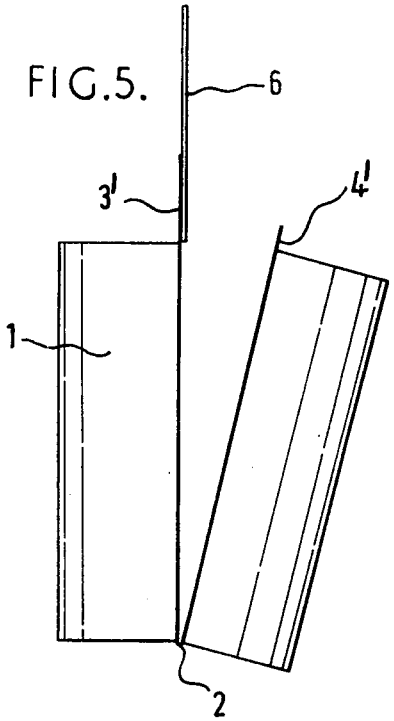
FIGS. 5, 6 and 7 show a modification of the embodiment of FIGS. 1 to 4 wherein a card is fixed to one flange and the other flange is adapted to releasably engage the case to connect the flanges together.
Figure 6:
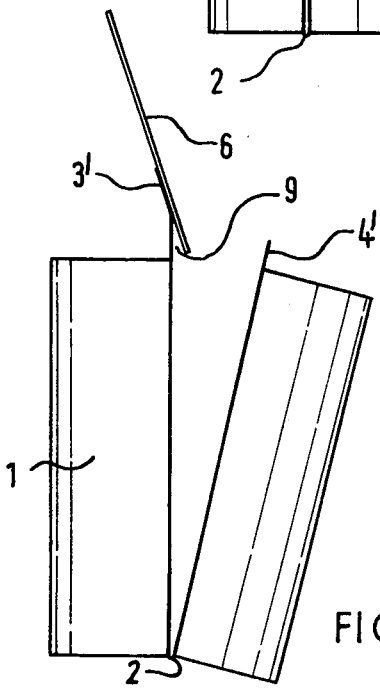
Figure 7:
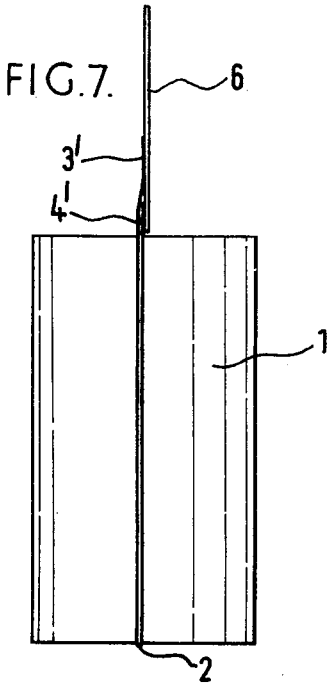

The modification illustrated in FIGS. 5, 6 and 7 is similar to the embodiment of FIGS. 1 to 4 except that the card 6 is affixed to only the flange 3' so that the package may be selectively opened and or closed by pivoting the portions 3 and 4 at the fold line 2. The card 6 is affixed only to the upper part (as viewed in the drawings) of the flange 3' so that when card 6 is tilted there is a gap 9 as shown in FIG. 6. The flange 4' of the other portion is slightly shorter than the flange 3' so that it may be moved under the card 6 and when the card is returned to its vertical position it retains the flange 4' against the flange 3' thereby closing the package. Thus, the package may be opened or closed at will.

Alternative means of closing the package (i.e. connecting the flanges 3' and 4' together) in any of the forms may be varied, for instance press studs or clips may be used. The press studs may be snap-together studs formed in the plastics material, the studs being passed through a corresponding hole or corresponding holes in the card to allow hand closure of the package by pressing the flanges 3' and 4' together. The card 6 may be affixed to the flange 3' and optionally the flange 4' by heat, thermal inpulse high frequency, staples or adhesives.

If desired to completely seal the package all the edges of the piece 1 of thermoplastics material may be sealed.

Figure 8:
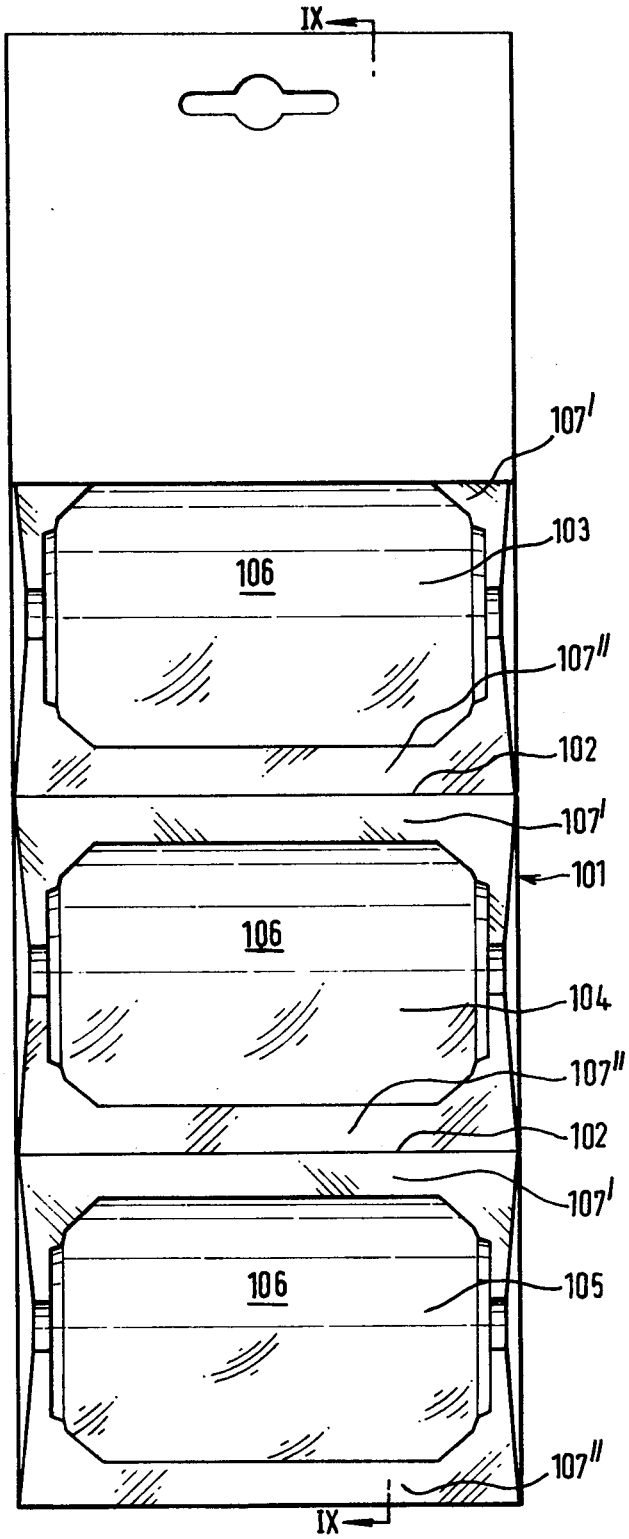
FIG. 8 illustrates another sheet of thermoplastics material moulded into shape.
Figure 9:
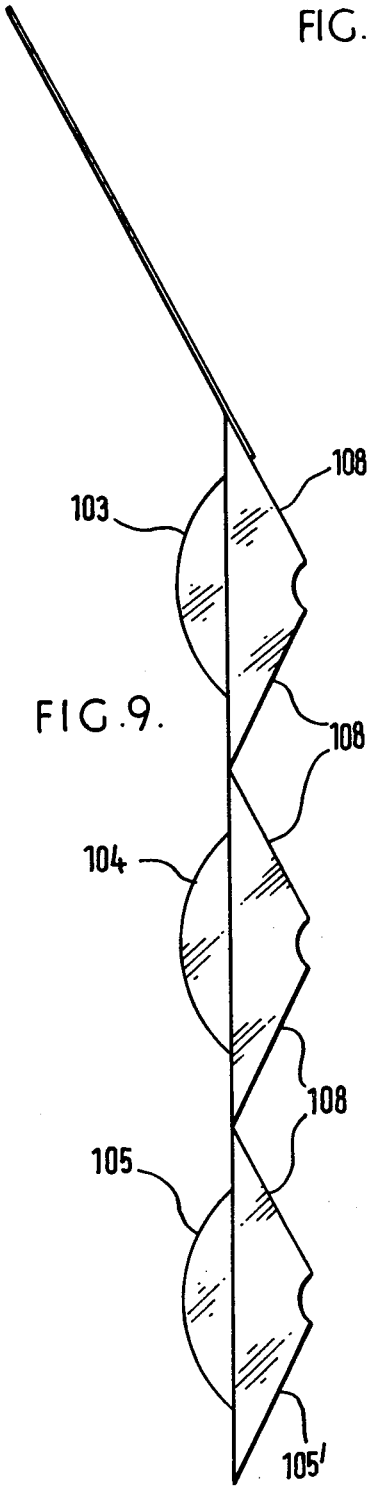
FIG. 9 is a section on line IX—IX of FIG. 8.

Referring to FIGS. 8 and 9, a piece 101 of semi-rigid or rigid thermoplastic material has fold lines 102 dividing the piece into three portions 103, 104 and 105, each defining a respective cavity 106. Each of the three portions 103, 104 and 106 includes a pair of flanges 107' and 107'' bordering the cavity 106 defined by that portion and a pair of webs 108 interconnecting the flanges 107' and 107''. The flange 107' of the portion 103 is at one end of the piece 101 and the flange 107'' of the portion 105 is at the other end of the piece 101.

The piece 101 is formed by moulding a single sheet of semi-rigid or rigid thermoplastics material to form the fold lines 102 and the cavities 106 and to leave the flanges 107' and 107''.

Each cavity 106 has, in transverse section, the shape of a sector forming one third of a circle, the flanges 107' and 107'' bordering the cavity being disposed in planes at 120° to each other.

Figure 11:
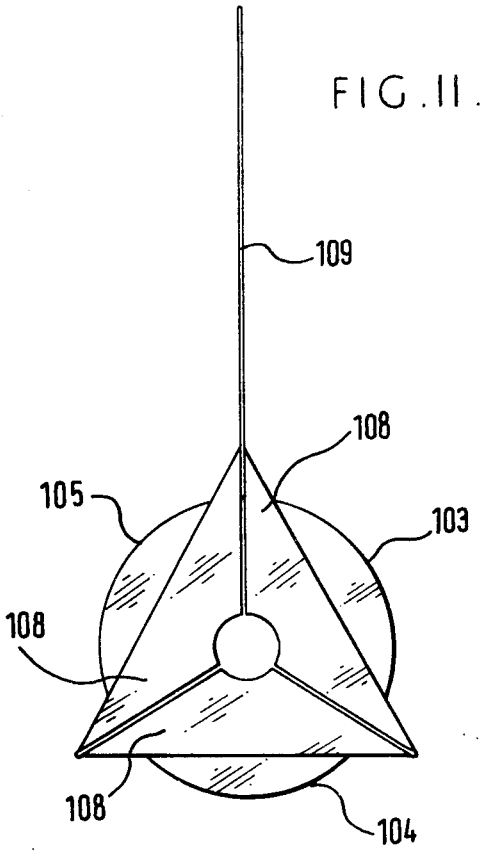
FIG. 11 is a side view of the completed package of FIG. 10.
Figure 10:
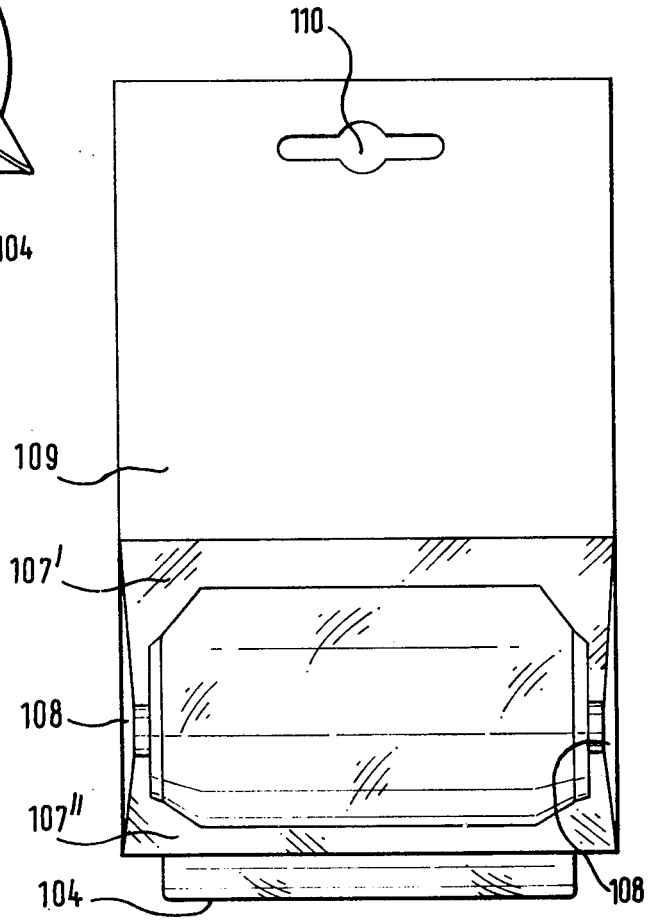
FIG. 10 represents a front view of a completed package comprising the thermoplastic sheet of FIG. 8.

A round-type dry battery is placed in one of the cavities 106 (either during the moulding of the piece 1 or later) and then the piece is folded along the fold lines 102 into the configuration shown in FIG. 11 to thereby encase the battery. A card 109 is fixed, e.g. by adhesive, by staples or by heat sealing, to the flange 107' of the portion 103 and the flange 107'' of the portion 105 and thus the package is sealed. In general, the flanges 107' and 107'' may be connected together by any of the means described above with reference to FIGS. 1 to 7. As described above, press studs may be used to connect the flanges together and attach the card.

The card 109 has a hole 110 for suspending the package. The portion 104 forms a base on which the package can stand without rolling away.

The card 109 may be affixed to only the flange 107' of the portion 103 to releasably engage the flange 107'' of the portion 105, as in the embodiment of FIGS. 5 to 7.

One method of forming the shape piece 1 or 101 of thermoplastics material comprises:

(a) a source of supply of plastics material in strip form is provided;

(b) passing the plastics material in strip form on a machine for shaping;

(c) shaping the plastics material by vacuum forming, pressure forming or thermo-forming; and (d) cutting the package to the required size and shape.

Alternatively the shaped piece 1 or 101 may be formed by pressing between two matching discs, i.e. simple pressing either after the application of heat or, using certain materials, when cold.

The cavities need not be provided in each of the portions, defined by the fold lines 2 or 102, of the piece 1 or 101 of thermoplastics material. One or more of the portions may have no cavities, the cavities in the remaining portion or portions being of suitable size and shape to accommodate the packaged articles or articles.

Where the card is fixed to two flanges of the piece 1 or 101 of material, the card may be held between the two flanges or both the flanges may be held on one side of the card. Alternatively, the card may be folded over to provide two portions the flanges being held between the two portions.

The piece 1 or 101 may be formed of transparent material so that the contents of the package (i.e. the battery or batteries) can be seen.

Where the card is a affixed to only one flange and another of the flanges is releasably engaged with the card, the former flange may be sealed to the card over a region leaving one or more regions between the flanges and the card partially surrounded by the sealed region and where there is no sealing, the other flange having one or more tongues for location in these unsealed region or regions to releasably engaged that flange with the card.

I claim:

1. A method of packaging one or more articles comprising the steps of forming a single transverse fold line in a piece of sheetform semi-rigid or rigid thermoplastic material so as to divide the piece of material into portions, forming one or more cavities for the one or more articles in at least one of the portions and having a flange at opposite ends of the piece of material, inserting the one or more articles in the one or more cavities in one of the portions, folding the piece of material about the single fold line to bring the portions together, affixing a card to one of said flanges, the card extending outwards from the piece of material, and releasably engaging the card with the other of said flanges to connect the flanges together to provide a package, the forming of said fold line in the piece of thermoplastic material and the forming of said one or more cavities comprising shaping and disposing the cavity such that a region of said material defining the cavity extends along the fold line and substantially normal to the general plane of the thermoplastic material whereby in the formed package said region or regions form a base for the package, on which base the package can be stood.

2. A method of packaging an article comprising the steps of forming a plurality of a transverse fold lines in a piece of sheet-form semi-rigid or rigid thermoplastic material so as to divide the piece of material into portions, forming a plurality of cavities for the article in a plurality of said portions and leaving a flange at opposite ends of the piece of material, each cavity being shaped and disposed such that a region of said material defining the cavity extends along the fold line and substantially normal to the general plane of the thermoplastic material, inserting the article in the cavity in one of the portions, folding the piece of material about the fold lines to bring the cavities together to make a larger cavity and to enclose the article, affixing a card to at least one of said flanges, the card extending outwards from the piece of material, and making a connection between said flanges whereby a package in formed and said region or regions form a base for the package on which base the package can be stood.

* * * * *

UNITED STATES PATENT AND TRADEMARK OFFICE

CERTIFICATE OF CORRECTION

PATENT NO. : 4,184,308

DATED : January 22, 1980

INVENTOR(S) : Anthony John Sharp

It is certified that error appears in the above–identified patent and that said Letters Patent are hereby corrected as shown below:

Col. 4, line 11 change "having" to --leaving--.

Signed and Sealed this

*Tenth* Day of *June 1980*

[SEAL]

*Attest:*

SIDNEY A. DIAMOND

*Attesting Officer*

*Commissioner of Patents and Trademarks*